US008016567B2

(12) United States Patent
Praisner

(10) Patent No.: US 8,016,567 B2
(45) Date of Patent: Sep. 13, 2011

(54) SEPARATION RESISTANT AERODYNAMIC ARTICLE

(75) Inventor: Thomas J. Praisner, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 1424 days.

(21) Appl. No.: 11/654,407

(22) Filed: Jan. 17, 2007

(65) Prior Publication Data

US 2010/0266385 A1 Oct. 21, 2010

(51) Int. Cl.
*F01D 5/14* (2006.01)
*F04D 29/68* (2006.01)

(52) U.S. Cl. ..... 416/231 R; 416/231 A; 416/223 A; 415/914

(58) Field of Classification Search ..... 416/231 R, 416/231 B, 223 A; 415/914
See application file for complete search history.

(56) References Cited

U.S. PATENT DOCUMENTS

| | | | | |
|---|---|---|---|---|
| 1,066,988 | A * | 7/1913 | Boutwell | 416/231 R |
| 2,135,887 | A | 11/1938 | Fairey | |
| 2,166,823 | A | 7/1939 | Rosenlocher | |
| 2,340,417 | A | 2/1944 | Ellett | |
| 2,637,487 | A | 5/1953 | Sawyer | |
| 3,316,714 | A * | 5/1967 | Smith et al. | 415/178 |
| 3,527,543 | A * | 9/1970 | Howald | 416/231 R |
| 3,749,520 | A * | 7/1973 | Bandukwalla | 416/183 |
| 4,714,408 | A | 12/1987 | Abe | |
| 5,193,975 | A | 3/1993 | Bird et al. | |
| 5,613,649 | A * | 3/1997 | Schlinker et al. | 244/1 N |
| 6,139,259 | A | 10/2000 | Ho et al. | |
| 6,354,804 | B1 * | 3/2002 | Leung | 416/231 R |
| 6,435,815 | B2 | 8/2002 | Harvey et al. | |
| 6,948,906 | B2 | 9/2005 | Leishman et al. | |
| 2005/0147497 | A1 * | 7/2005 | Doerffer et al. | 416/231 R |

FOREIGN PATENT DOCUMENTS

| | | |
|---|---|---|
| EP | 1118747 | 7/2001 |
| EP | 1533529 | 5/2005 |

OTHER PUBLICATIONS

Sondergaard, Bons and Yurchenko, Control of Separation in Turbine Boundary Layers AIAA 2004-2201, Jun. 2004.
Bons, Sondergaard and Rivir, The Fluid Dynamics of LPT Blade Separation Control Using Pulsed Jets 2001-GT-0190, Jun. 2001.
Sondergaard, Sucher, Bons and Rivir, Reducing Low-Pressure Turbine Stage Blade Count Using Vortex Generator Jet Separation Control GT-2002-30602, Jun. 2004.
Non-published pending patent application, filed Oct. 12, 2006 PCT/US2006/039797.
European Search Report dated Dec. 29, 2010.

* cited by examiner

*Primary Examiner* — Igor Kershteyn
(74) *Attorney, Agent, or Firm* — Carlson, Gaskey & Olds

(57) ABSTRACT

An airfoil disclosed herein comprises a pressure surface 42 exposed to a stream of fluid, a suction surface 40 exposed to the stream of fluid and a passage 56 extending from a passage intake end 60 to a passage discharge end 66. The intake end has an intake opening 62 penetrating the pressure surface for extracting fluid from the fluid stream. The discharge end has a discharge opening 68 penetrating the suction surface upstream of a natural separation point 52. The discharge end is configured to inject the extracted fluid into the fluid stream at a jet angle whose components include at least one of a nonzero streamwise angle $\alpha$ in a prescribed angular range and a nonzero cross-stream angle $\beta$.

19 Claims, 5 Drawing Sheets

FIG. 1
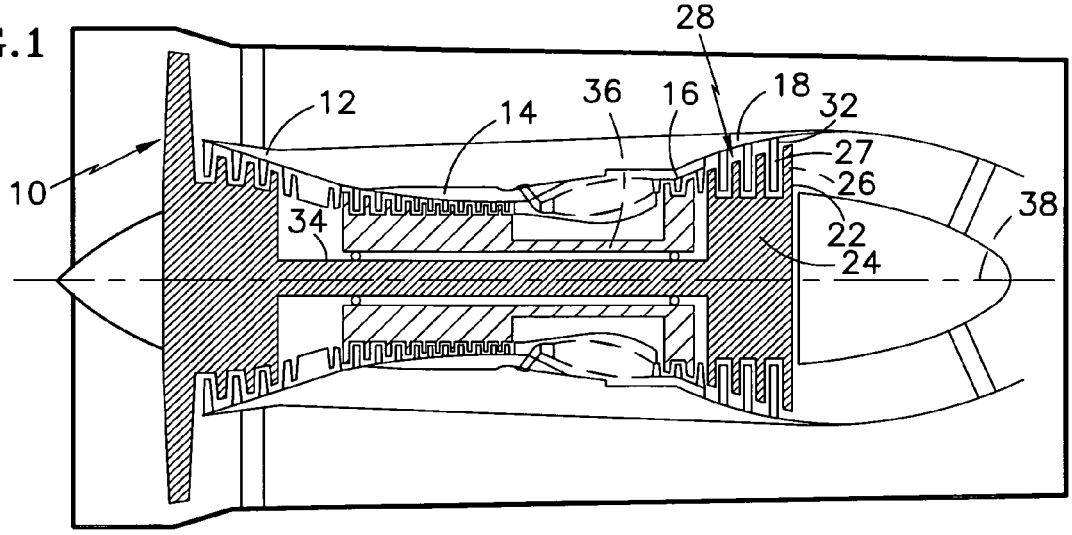
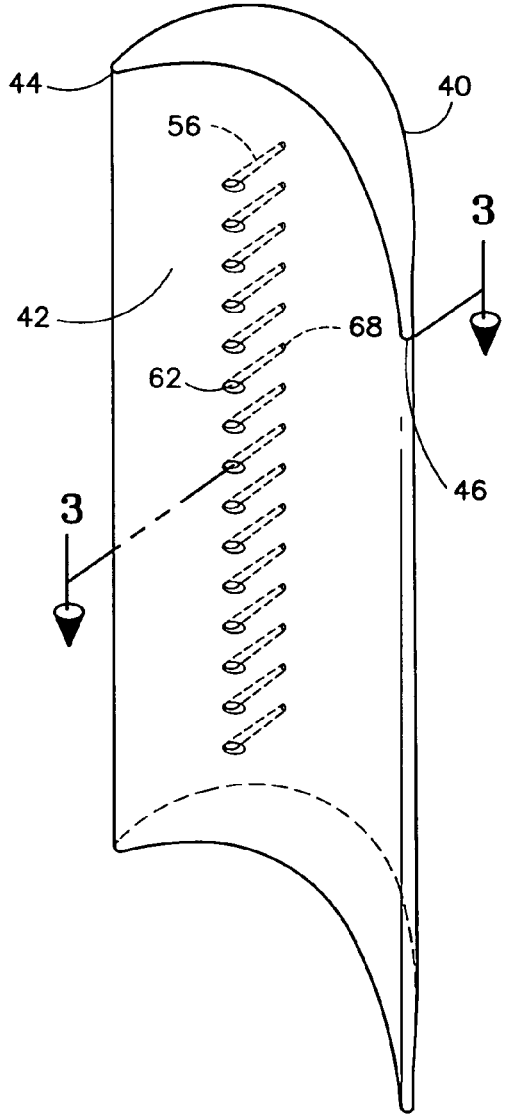
FIG. 2

FIG.7
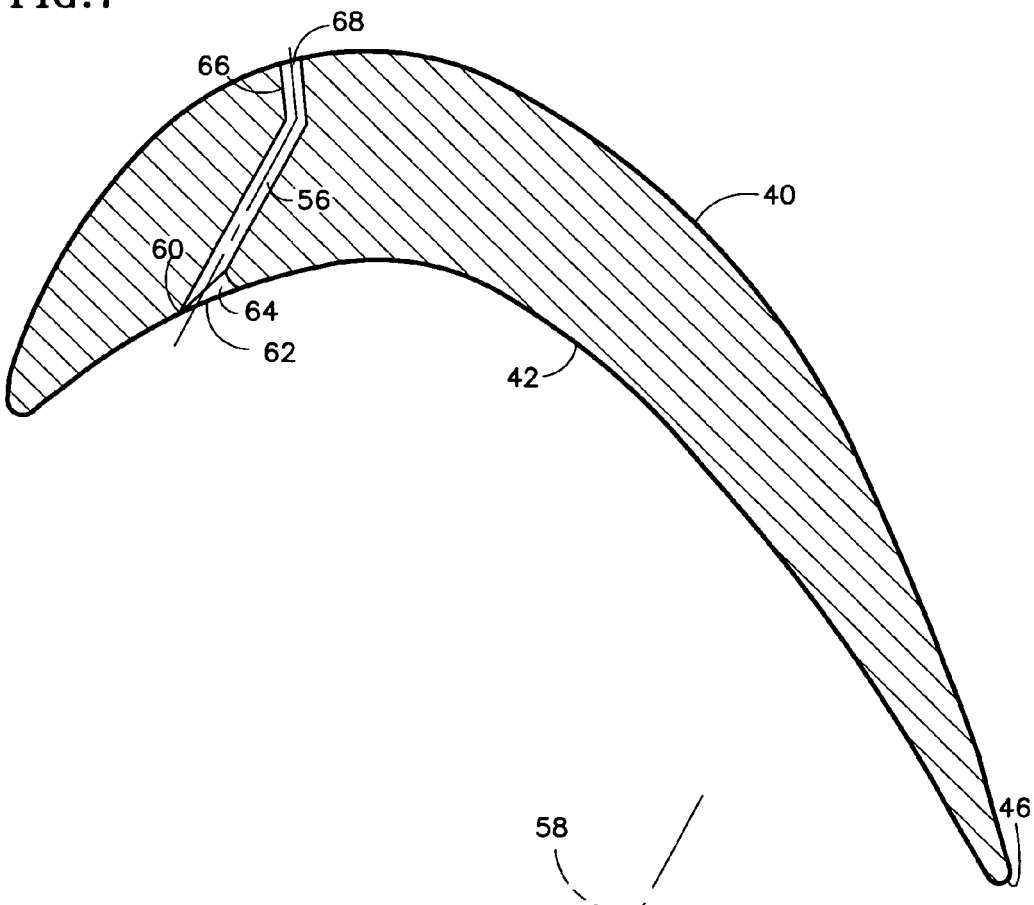
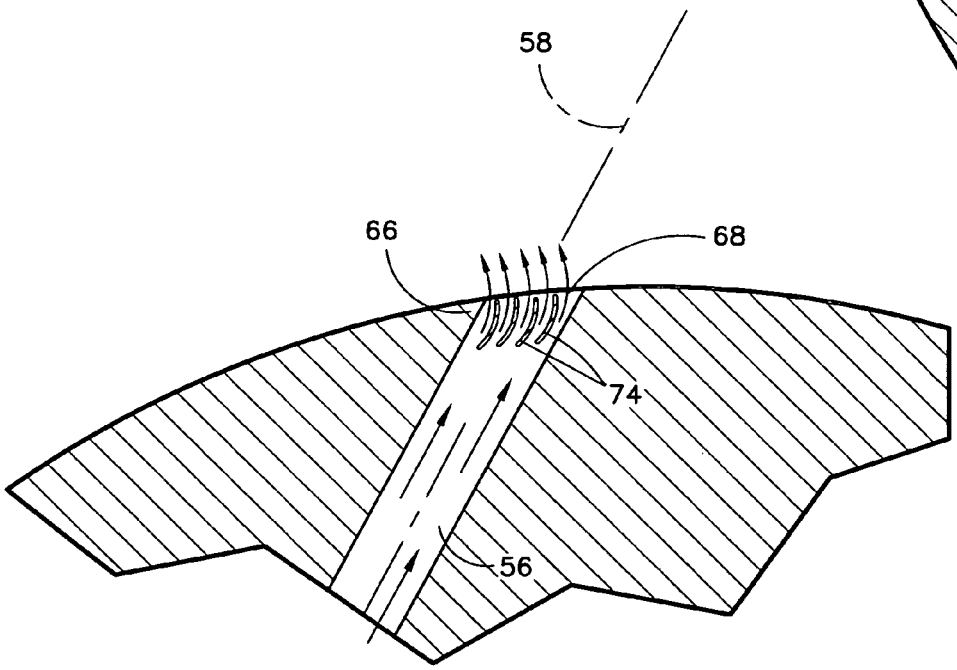
FIG.8

SEPARATION RESISTANT AERODYNAMIC ARTICLE

TECHNICAL FIELD

This application discloses articles having surfaces for achieving improved aerodynamic performance and particularly describes a turbomachinery airfoil that resists fluid separation.

BACKGROUND

Gas turbine engines employ compressors and turbines each having arrays of blades and vanes. Each blade or vane includes an airfoil having a suction surface and a pressure surface. During engine operation, a stream of working medium fluid flows over the airfoil surfaces. Under some conditions the airfoil surfaces, especially the suction surface, are susceptible to undesirable fluid separation that compromises the aerodynamic performance of the airfoil. Turbine airfoils that are highly loaded and operate at low Reynolds Number are particularly susceptible to fluid separation. Such highly loaded airfoils are attractive because their use allows an engine designer to reduce airfoil count and thus reduce the weight, cost and complexity of the engine. It is, therefore, desirable to impart separation resistance to such airfoils so that they can be employed effectively.

One known technique for combating separation is to use vortex generator jets (VGJ's). An airfoil designed for VGJ operation includes an internal plenum and a series of spanwisely distributed passages extending from the plenum to the suction surface. During engine operation, pressurized fluid flows into the plenum and through the passages. Each passage discharges a jet of the pressurized fluid (a vortex generator jet) into the working medium fluid flowing over the suction surface. Each jet penetrates through the fluid boundary layer on the suction surface and interacts with the free stream portion of the working medium fluid to create a pair of counterrotating, streamwisely extending vortices in the free stream. The vortices transport higher momentum free stream fluid into the lower momentum boundary layer, thereby counteracting any proclivity for fluid separation. Although this approach is successful, the pressurized fluid used in conventional VGJ arrangements is air extracted from the engine compressor. The air extraction diminishes engine efficiency. Moreover, the supply system required to convey the compressed air to the airfoil plenum introduces mechanical complexity into the engine.

It is, therefore, desirable to devise an airfoil capable of taking advantage of VGJ's without being encumbered by efficiency losses and mechanical complexity.

SUMMARY

An airfoil disclosed herein comprises a pressure surface exposed to a stream of fluid, a suction surface exposed to the stream of fluid and a passage extending from a passage intake end to a passage discharge end. The intake end has an intake opening penetrating the pressure surface for extracting fluid from the fluid stream. The discharge end has a discharge opening penetrating the suction surface upstream of a natural separation point. The discharge end is configured to inject the extracted fluid into the fluid stream at a jet angle whose components include at least one of a nonzero streamwise angle in a prescribed angular range and a nonzero cross-stream angle.

The foregoing and other features of the various embodiments of the airfoil described herein will become more apparent from the following detailed description and the accompanying drawings.

BRIEF DESCRIPTION OF THE DRAWINGS

FIG. 1 is a schematic side elvation view of a turbofan gas turbine engine.

FIG. 2 is a perspective view of an airfoil for the engine of FIG. 1 showing a series of passages, each having a discrete inlet opening and a discrete discharge opening, extending through the airfoil.

FIG. 7 is a view similar to FIG. 3 showing an alternate configuration of the passage.

FIG. 8 is a view similar to FIG. 3 showing another alternate configuration of the passage including turning vanes.

DETAILED DESCRIPTION

Figure 3:
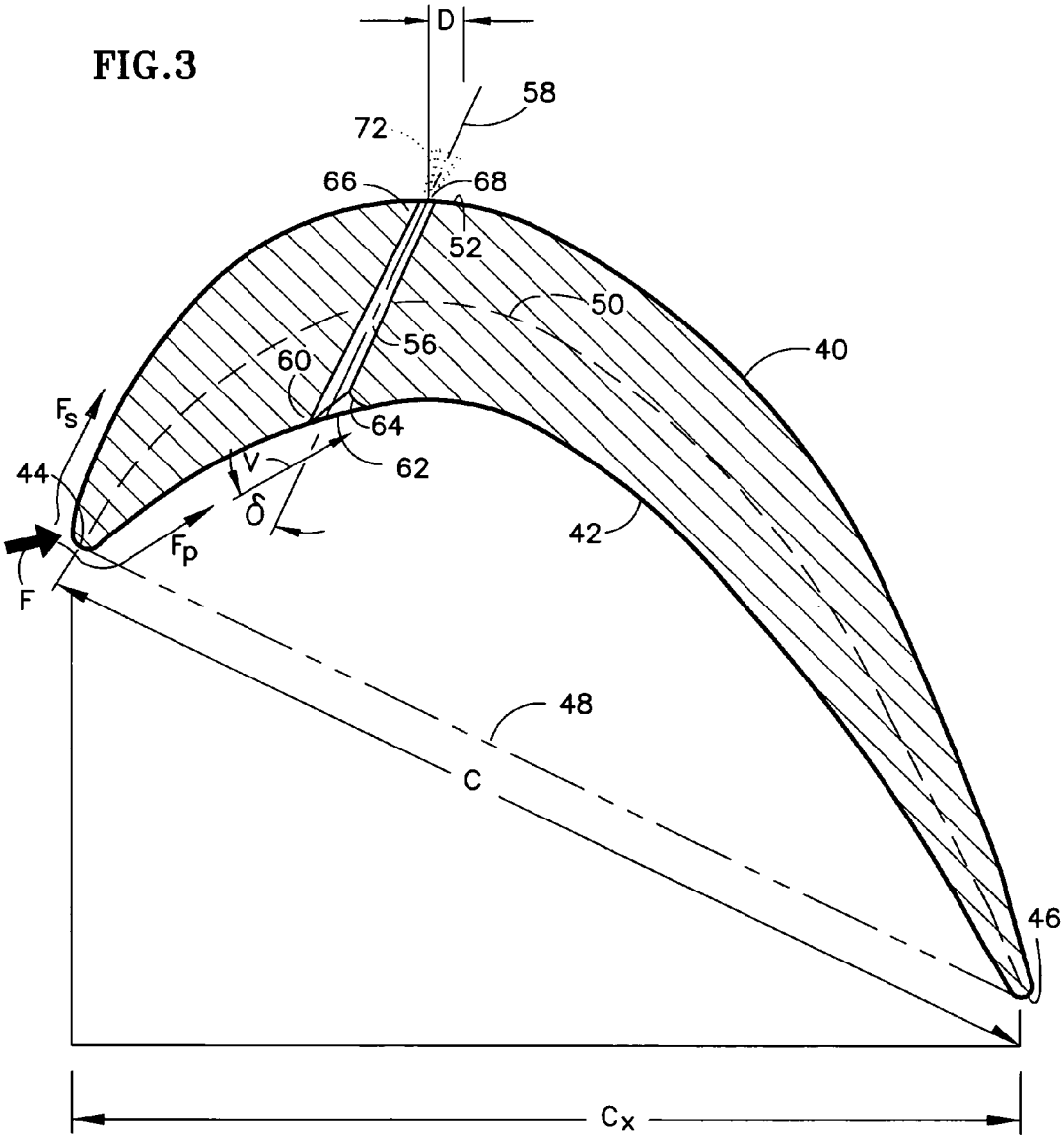
FIG. 3 is a view taken in the direction 3-3 of FIG. 2 showing one of the passages.

Referring to FIG. 1, a typical, dual spool gas turbine engine includes a fan 10, a low pressure compressor 12, a high pressure compressor 14, a high pressure turbine 16 and a low pressure turbine 18. The fan, compressors and turbines each include one or more arrays of circumferentially distributed blades such as low pressure turbine blade 22 secured to a hub such as low pressure turbine hub 24. Each blade includes an airfoil 26 that spans radially across a working medium flowpath 28. The compressors and turbines also each include one or more arrays of circumferentially distributed vanes such as low pressure turbine vane 32. The vanes also include airfoils 27 that span radially across the flowpath. A low spool shaft 34 connects the low pressure turbine hub to the fan and low pressure compressor hubs. A high spool shaft 36 connects the high pressure turbine hub to the high pressure compressor hub. During engine operation, the shafts rotate about an engine axis or centerline 38.

Referring to FIGS. 2 and 3, an airfoil includes a suction surface 40, and a pressure surface 42 extending substantially nondiscontinuously (without, for example, ridges, notches and steps) from a leading edge 44 to a trailing edge 46. A chord line 48 extends linearly from the leading edge to the trailing edge. Airfoil chord C is the length of the chord line. Airfoil axial chord $C_x$ is the length of the chord line projected onto a plane containing the engine centerline. A mean camber line 50 extends from the leading edge to the training edge midway between the suction and pressure surfaces. During engine operation, a working medium fluid F splits into substreams $F_s$ and $F_p$ and flows over the airfoil. The airfoil may be susceptible to fluid separation, especially along the suction surface. The onset of suction surface separation naturally occurs at a point 52, whose exact position depends at least partly on airfoil shape. The separation point 52 is defined given operation of the airfoil as a turbine blade.

The airfoil also includes a passage 56 having a meanline 58 for conveying fluid from the pressure side 42 of the airfoil to the suction side 40 of the airfoil. The passage 56 has an intake end 60 with an intake opening 62 that penetrates the pressure surface 42 for extracting fluid from the fluid stream $F_P$. The intake end includes a fillet 64. The intake end is oriented so that it faces upstream (i.e. toward) the oncoming fluid stream $F_P$, i.e. the local velocity vector V forms an acute angle δ with the meanline 58. The intake opening may penetrate the pressure surface at any convenient location. However because the static pressure of the fluid stream $F_P$ decreases as it flows along the pressure surface, particularly aft of about 50% of the axial chord $C_x$, it may be desirable to locate the intake opening within the first 50% of axial chord, and as far upstream as practicable. The illustrated passage is substantially linear and defines a substantially linear pathway between the pressure surface and the suction surface. The passage may also be nonlinear, however a linear passage with a correspondingly short length is desirable to minimize aerodynamic losses in fluid flowing through the passage.

The passage 56 also has a discharge end 66 with a discharge opening 68 that penetrates the suction surface. The opening 68 is located upstream of the point 52 of separation onset by a distance D, which is typically no more than about 20% of the axial chord $C_x$. The term "upstream", as used herein to describe and claim the location of the opening 68 relative to separation point 52, includes a location at the separation point itself. In the illustrated variant of the airfoil, the discharge opening 68 is chordwisely aft or downstream of the intake opening 62. The pressure gradient between the pressure surface and the suction surface extracts working medium fluid from the pressure side of the airfoil and drives it through the passage. The extracted fluid is injected as a jet 72 into the fluid stream flowing along the suction side of the airfoil. The discharge end is configured to inject the jet at a jet angle whose components include at least one of a nonzero streamwise angle α in a range of about 45° to about 110° and a nonzero cross-stream angle β.

Figure 5:
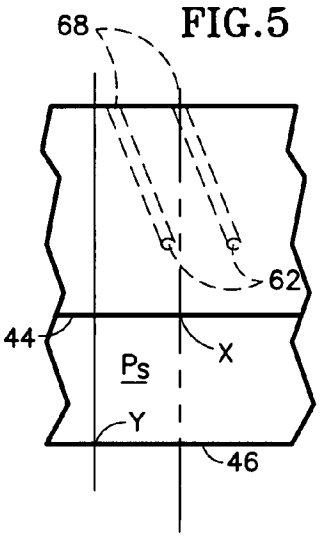
FIG. 5 is a view in the direction 5-5 of FIG. 4.
Figure 6:
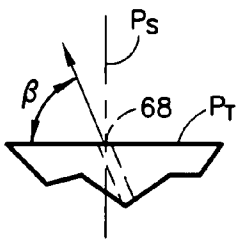
FIG. 6 is a view in the direction 6-6 of FIG. 4.
Figure 4:
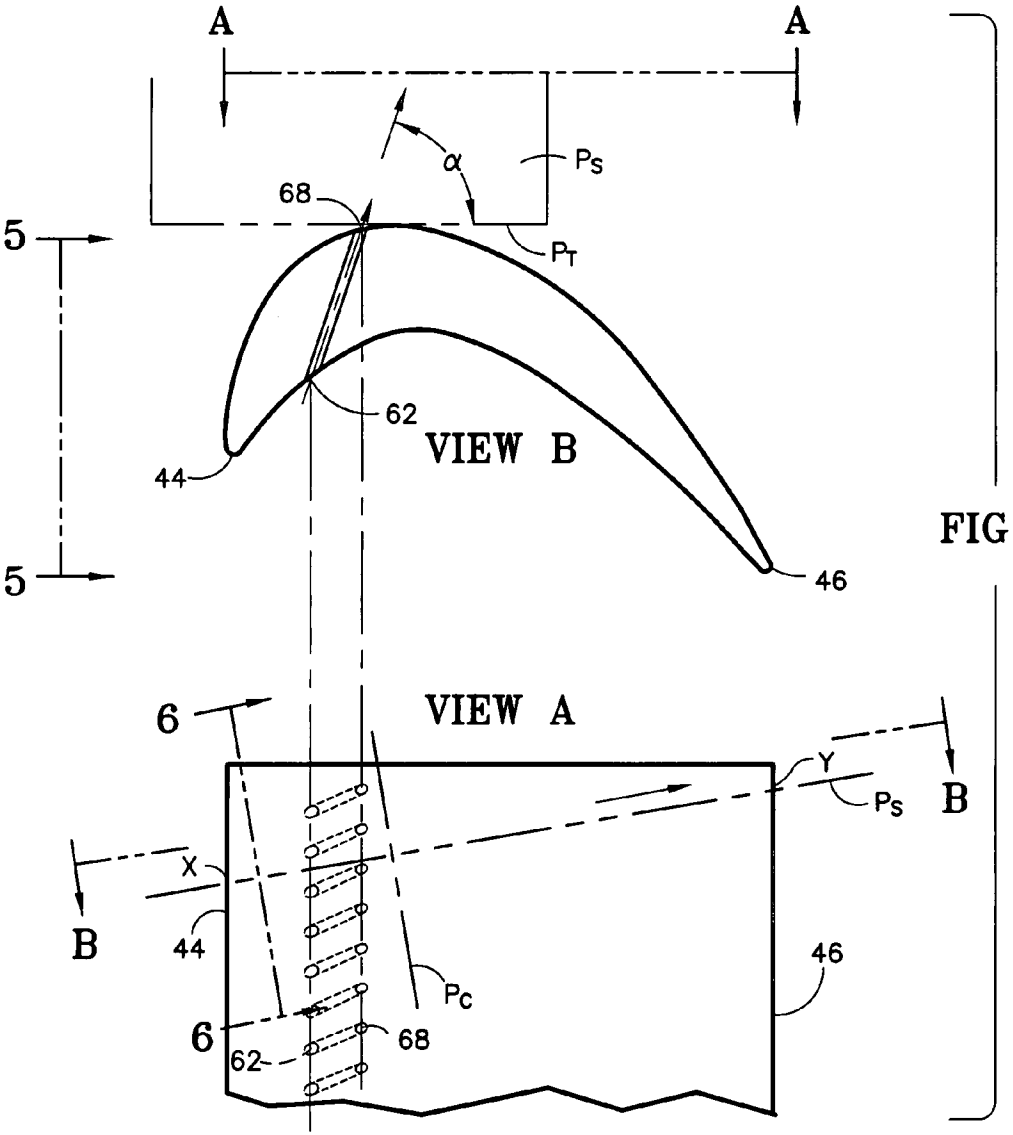
FIG. 4 is a fragmentary plan view (View A) and a cross sectional view (View B) in the direction B-B of View A showing planes related to the measurement of a jet angle.

Referring now to FIGS. 4-6, the streamwise angle α is measured in a plane $P_S$ parallel to the local streamwise direction of the working medium fluid, which direction may have a radial (i.e. spanwise) component as well as a chordwise component. The angle α is measured as shown from a reference plane $P_T$ tangent to the airfoil suction surface at the passage meanline 58. The angle α is in the range of about 45° to about 110°, (i.e. the jet may be oriented up to about 20° in the forward direction). However it is believed that an angle α in the range of about 60° to about 90° imparts good separation resistance without introducing unacceptably high aerodynamic losses into the fluid stream $F_S$.

The cross-stream angle β is an acute angle measured in a plane $P_C$ perpendicular to plane $P_S$. The angle β is measured as shown from the reference plane $P_T$. The angle β is in the range of about 30° to about 60°.

The discharge end of the passage may be configured to inject the jet 72 at a prescribed jet angle by merely orienting the entire passage 56, including the discharge end, at that same angle as suggested in FIG. 3. However other ways to inject the jet at the prescribed jet angle may also be satisfactory. For example, as seen in FIG. 7, the passage may be angled or curved so that only the discharge end is oriented at the jet angle. Another example, seen in FIG. 8, may use nanomachined turning vanes 74, at the passage discharge end to configure the passage to inject the jet at the desired jet angle.

The passage 56 may be installed in the airfoil by any suitable means, such as laser drilling or electro-discharge machining. For cast airfoils, the passage may also be created during the airfoil casting process.

Figure 9:
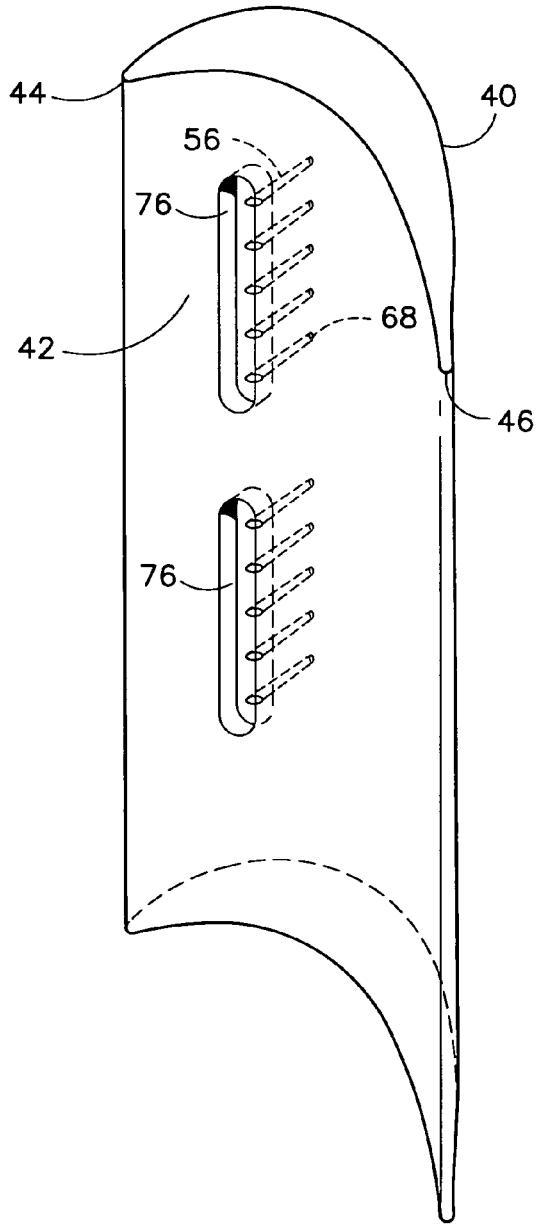
FIG. 9 is a perspective view of an airfoil showing inlet openings in the form of slots communicating with multiple, discrete discharge openings.

As seen best in FIG. 2, a typical airfoil would employ an array of passages, each with an intake opening and a corresponding discharge opening such that the discharge openings comprise an array of discrete ports extending linearly or nonlinearly at least partly in the spanwise direction. Alternatively, as seen in FIG. 9, the intake opening may comprise one or more slots 76 extending at least partly in the spanwise direction. Each slot communicates with at least one discharge opening 68.

Although this disclosure refers to specific embodiments, it will be understood by those skilled in the art that various changes in form and detail may be made without departing from the subject matter set forth in the accompanying claims.

I claim:

1. An airfoil, comprising:

a pressure surface exposed to a stream of fluid;

a suction surface exposed to the stream of fluid and susceptible to fluid separation;

a passage extending from a passage intake end to a passage discharge end, the intake end having an intake opening penetrating the pressure surface for extracting fluid from the fluid stream, the discharge end having a discharge opening penetrating the suction surface upstream of a natural separation point and being configured to inject the extracted fluid into the fluid stream at a jet angle whose components include at least one of a nonzero streamwise angle in a range of about 45° to about 110° and a nonzero cross-stream angle; and said discharge opening penetrating the suction surface at a distance upstream of the separation point equal to no more than about 20% of an airfoil axial chord, and the discharge opening being chordwisely aft of the intake opening.

2. The airfoil of claim 1 wherein the cross stream angle is in a range of about 30° to about 60°.

3. The airfoil of claim 1 wherein the streamwise angle is between about 60° and 90°.

4. The airfoil of claim 1 wherein the intake opening comprises a slot extending at least partly in a spanwise direction.

5. The airfoil of claim 1 wherein the discharge opening is an array of discrete ports extending at least partly in a spanwise direction.

6. The airfoil of claim 1 wherein the discharge end is oriented to inject the extracted fluid at the jet angle.

7. The airfoil of claim 1 wherein the intake opening faces in an upstream direction.

8. The airfoil of claim 1 wherein the passage is a substantially linear pathway from the pressure surface to the suction surface.

9. The airfoil of claim 1 wherein the suction surface and the pressure surface both extend substantially nondiscontinuously from an airfoil leading edge to an airfoil trailing edge.

10. The airfoil of claim 1 wherein the airfoil is a turbine airfoil for a turbine engine.

11. The airfoil of claim 10 wherein the airfoil is a low pressure turbine airfoil.

12. The airfoil of claim 10, wherein the separation point is defined at a location where fluid would separate from the suction surface of the airfoil when the airfoil is utilized as a turbine blade in a turbine engine.

13. An airfoil comprising:

a pressure surface exposed to a stream of fluid;

a suction surface exposed to the stream of fluid and susceptible to fluid separation at a natural separation point, and the airfoil being utilized as a turbine blade in a gas turbine engine, the separation point being defined at a location where fluid would separate from the suction surface of the airfoil when the airfoil is utilized as a turbine blade in a turbine engine;

a passage extending from a passage intake end to a passage discharge end, the intake end having an intake opening penetrating the pressure surface for extracting fluid from the fluid stream, the discharge end having a discharge end penetrating the suction surface upstream of the natural separation point;

the discharge opening penetrating the suction surface at a distance upstream of the separation point equal to no more than about 20% of an airfoil axial chord; and the discharge opening being chordwisely aft of the intake opening.

14. The airfoil of claim 13, wherein the discharge opening is configured to eject the extracted fluid into the fluid jet stream at a jet angle whose components include a non-zero streamwise angle in a range of about 45° to about 110°.

15. The airfoil of claim 14, wherein the streamwise angle is between about 60° and 90°.

16. The airfoil of claim 13, wherein the discharge opening is configured to eject the extracted fluid into the fluid stream at a jet angle, with there being a non-zero cross-stream angle.

17. The airfoil of claim 16, wherein the cross stream angle is in a range of about 30° to about 60°.

18. The airfoil of claim 13, wherein the intake opening comprises a slot extending at least partly in a spanwise direction.

19. The airfoil of claim 13, wherein the discharge opening is an array of discrete ports extending at least partly in a spanwise direction.

* * * * *